US007041040B2

(12) United States Patent
Dovner et al.

(10) Patent No.: US 7,041,040 B2
(45) Date of Patent: May 9, 2006

(54) ABDOMINAL EXERCISE SYSTEM

(75) Inventors: Edward R. Dovner, Avon, MA (US); William Harvey, Long Island City, NY (US)

(73) Assignee: First Choice Armor & Equipment, Inc., Brockton, MA (US)

( * ) Notice: Subject to any disclaimer, the term of this patent is extended or adjusted under 35 U.S.C. 154(b) by 330 days.

(21) Appl. No.: 10/720,806

(22) Filed: Nov. 24, 2003

(65) Prior Publication Data

US 2005/0113224 A1 May 26, 2005

(51) Int. Cl.
*A63B 23/02* (2006.01)
*A63B 21/05* (2006.01)

(52) U.S. Cl. ..... 482/124; 482/126; 482/128; 482/140

(58) Field of Classification Search ..... 482/121, 482/122, 124, 126, 128, 140; 128/96.1; 601/23; D21/692, 693

See application file for complete search history.

(56) References Cited

U.S. PATENT DOCUMENTS

| | | | | |
|---|---|---|---|---|
| 3,228,392 | A * | 1/1966 | Speyer | 482/122 |
| 3,951,404 | A | 4/1976 | Brown | |
| 4,570,921 | A | 2/1986 | Arnold | |
| 4,733,862 | A | 3/1988 | Miller | |
| 4,775,148 | A * | 10/1988 | McLaughlin | 482/124 |
| 4,852,874 | A | 8/1989 | Sleichter, III et al. | |
| 5,007,635 | A | 4/1991 | Tiller | |
| 5,050,875 | A * | 9/1991 | Lewkovich | 482/128 |
| 5,160,304 | A * | 11/1992 | Van Der Hoeven | 482/128 |
| 5,514,059 | A | 5/1996 | Romney | |
| 5,595,559 | A | 1/1997 | Viel | |
| 5,616,109 | A * | 4/1997 | Szu-Ming | 482/123 |
| 5,695,436 | A * | 12/1997 | Huang | 482/121 |
| 5,749,815 | A * | 5/1998 | Lipps | 482/122 |
| 5,776,041 | A | 7/1998 | Fisher | |
| 5,800,322 | A | 9/1998 | Block | |
| 5,882,284 | A * | 3/1999 | Cayne | 482/130 |
| 6,048,291 | A | 4/2000 | Fisher | |
| 6,616,582 | B1 * | 9/2003 | Jiang | 482/140 |
| 2005/0014615 | A1 * | 1/2005 | Wong | 482/128 |

FOREIGN PATENT DOCUMENTS

| | | | |
|---|---|---|---|
| EP | 30512 | A2 * | 6/1981 |
| JP | 05023402 | A * | 2/1993 |
| KR | 2000055303 | A * | 9/2000 |
| WO | WO 8704356 | A1 * | 7/1987 |

* cited by examiner

*Primary Examiner*—Stephen K. Cronin
*Assistant Examiner*—Victor K. Hwang
(74) *Attorney, Agent, or Firm*—Burns & Levinson LLP; Stephen Y. Chow; John A. Hamilton

(57) ABSTRACT

Exercise system comprised of plurality of modular components enabling numerous types of exercises. Resistive force provided by durable elastomeric tubing that is quickly connectable to and disconnectable from more rigid components. A configuration of the exercise system uses a back pad and a padded plate from which extends a guide rod and spring to present an abdominal exercise option to the user.

5 Claims, 19 Drawing Sheets

ABDOMINAL EXERCISE SYSTEM

FIELD OF THE INVENTION

The present invention relates generally to physical conditioning and/or rehabilitation devices, and more particularly to devices including elastic and rigid components and exhibiting selectable resistive forces and secure mechanical links between the elastic and rigid components.

BACKGROUND OF THE INVENTION

More people engage in exercising as a leisure activity than any other type of activity. Portable exercise devices have become more popular because they are generally inexpensive to manufacture and are readily transportable so that a regular program of physical fitness can be maintained.

One simple portable exercise device consists of a bar with a single elastic member three or four feet long and extending between the two ends so that a person could hold the bar and push down on the rope with his feet. A variation of this device consists of an elastic rope with two handles at the ends of the rope replacing the bar.

The resistance this type of device is able to provide is variable only by extending the body part being exercised through, and perhaps beyond, what may be the desired range of motion. For example, the resistive force that an elastic cord provides through a fixed range of motion is predetermined. Such devices eventually fail to challenge a user as the user's strength increases. Materials such as solid rubber may provide so much resistance that that they become difficult to stretch through the desired range of motion, and thus are not adaptable for use by a wide variety of users with different strengths and needs for exercise. Other exercise devices enable an adjustable level of resistance, but typically are associated with a commensurate increase in cost and complexity. Such devices may also require electrical power and occupy additional space. Moreover, the devices may also require electrical power and are hazardous.

Another potential problem associated with this device is that it is difficult to eliminate the danger of injury from a handle that has broken off from the elastic rope during use. In particular, difficulty exists in existing exercise devices in coupling the elastic member to the handles. In many of these types of devices, the mechanical links between the elastic member and the handles are subjected to a great deal of tensile force, which may be applied to the elastic member where it directly contacts the handles.

Thus, it is desirable to have an exercise device that is easily reconfigurable to enable different exercises and/or a selection of resistive force.

It is further desirable to reduce the likelihood of injury mentioned above by minimizing the possibility of failure of the mechanical link between the elastic member and more rigid components through a more secure connection than previously employed in the art.

SUMMARY OF THE INVENTION

For a better understanding of the present invention, reference is made to the accompanying drawing and detailed description. The scope of the present invention will be pointed out in the appended claims.

The present invention provides an exercise system that is portable, light-weight, and comprised of a number of components that are easily reconfigured to allow a user to perform a wide variety of exercises. Most configurations described below employ elastomeric tubing preferably between 1/16" and 1/4" in width to provide resistive force during exercise motions, and preferably latex due to latex's high durability and elastic qualities. The descriptions below referring to "latex" tubing are not, therefore, intended to include other elastomeric materials.

As used herein, the terms limb-engaging and body-part-engaging refer to portion of the exercise system's components that come into contact with the user. A limb-engaging component, for example, refers to bars that may be gripped, plates that may be stood upon, stirrups into which a user's feet may be inserted, and so on. The term body-part engaging is slightly broader, in that it may also refer to the several pads provided by the invention that are intended to, for example, hook over the user's shoulder, or wrap around the user's back, etc. Several of the pad embodiments are equipped with sleeves, i.e. one or more channels preferably formed of fabric that is interwoven or otherwise attached to one of the pads and through which an adjustable strap is placed. The term terminator is used to refer to end connector part of, for instance, either a strap or a more rigid (e.g., metal) connection component, such as an eye loop or carabiner. In the several embodiments of the invention, strap terminators can be metal connectors such as rings, but may equally be comprised of fabrics.

In one aspect described below, the invention provides a novel connection configuration employing an arrangement of cylindrical bushings, elastomer tubing (preferably latex), and a threaded member. The connection provides a very secure attachment between the tube and the metal parts that decrease the risk of disconnection and/or breakage present in some existing exercise systems. The threaded member may also include at one end a quick connector that allows modular components of the exercise system to be rapidly reconfigured without the use of pins or knots or the like.

In another aspect, the present invention provides elastomer tubing assemblies incorporating the connection configuration discussed above, and preferably the quick connector. The preferably latex tubing assemblies are used to provide a resistive force selectable by the user by choosing the tubing width and lengths to use in the exercise, as well as the number of latex tube assemblies to use. The latex tubing assemblies span are connected to rigid bars on one end, and then the limb or body part engaging components, such as shoulder and back pads, foot plates and stirrups, etc. The present invention provides a number of means for adjusting the distance between the bar and modular components, beyond the selection of a latex tubing assembly of the exact distance desired. The rigid bar may be short, such as for exercises intended to use a single hand, or longer for two hands. In some embodiments, the bar is comprised of a central segment to which handle extensions may be added on each side of the central segment.

In another aspect, the present invention provides a configuration using the latex tubing to span two handle portions that are securely connected to the tube, thereby allowing an exercise motion involving pulling the handles in opposite directions.

In yet another aspect, the present invention provides a configuration of the exercise system using the back pad and a padded plate from which extends a guide rod and spring to present an abdominal exercise option to the user. As with each configuration of the exercise system, various connection, length and resistive force adjustments are available to the user.

BRIEF DESCRIPTION OF THE DRAWING

The advantages of the present invention will be apparent in the following detailed description of the illustrative embodiments thereof, which is to be read in connection with the accompanying drawing, wherein.

DETAILED DESCRIPTION OF PREFERRED EMBODIMENTS OF THE INVENTION

Figure 1A:
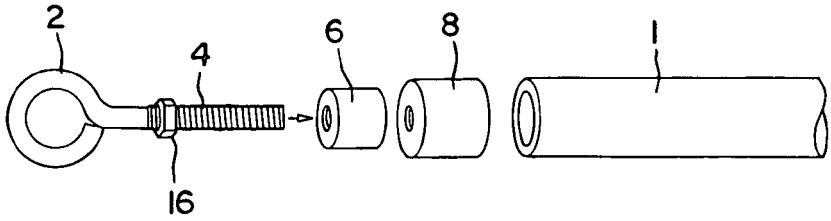
FIGS. 1A–1F are side, cross-sectional and exploded view schematic illustrations of an eye-loop embodiment of a latex tubing connector portion of an exercise system in accordance with the present invention.

Preferred embodiments of the present invention will now be described with reference to the several figures of the drawing.

Figure 4:
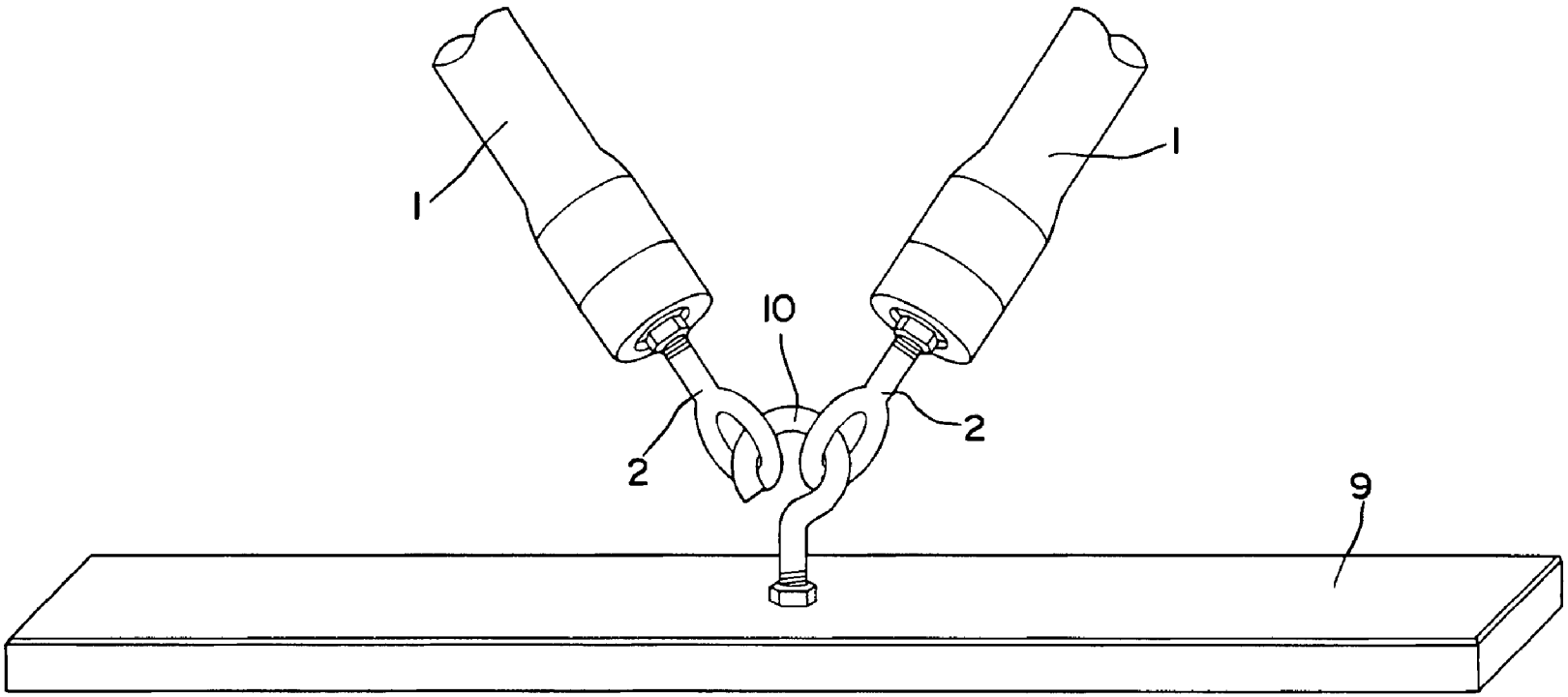
FIG. 4 is a schematic illustration of a foot plate having a hook and the connected ends of several latex tubing assemblies.

FIG. 1A shows a connector portion of an exercise system in accordance with the present invention. Illustrated are elastic tubing 1, preferably of pure latex, of ⅛" wall thickness that provides resistive force to a person using the system, a eye-bolt 2 having a thread portion 4 that is to be threaded through a smaller threaded bushing 6 and a larger threaded bushing 8. With reference to FIG. 4, one or more eye-bolts 2 may be slid onto a hook 10 in order to connect an elastic tube assembly to an engaging member 9 that is intended to engage a portion of the user's body, such as the hands or feet, in order to provide a countering force during the exercise.

Figure 1B:
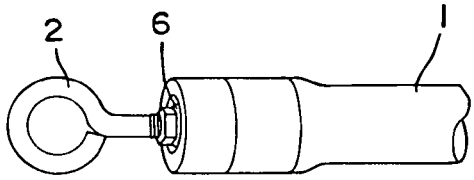
Figure 1C:
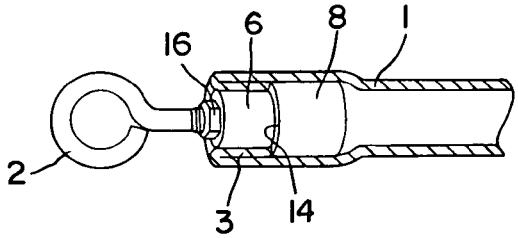
Figure 1D:
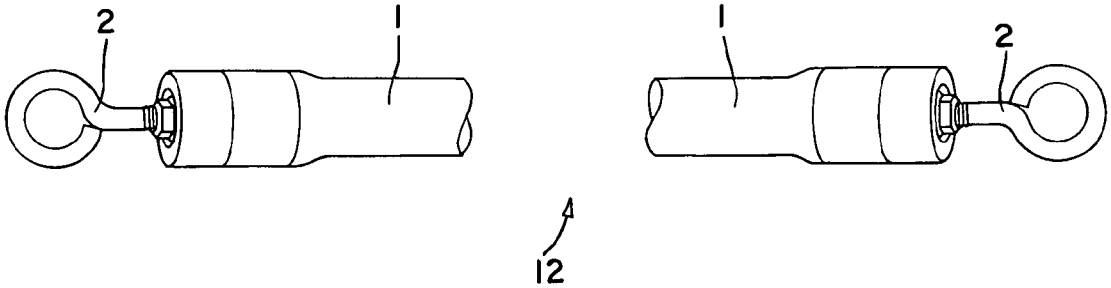

FIG. 1B shows an assembled connector portion, and FIG. 1D illustrates an elastic tube assembly 12 having an eye-bolt disposed at each end. FIG. 1C illustrates a cross section of the assembled connector portion reflecting a configuration that very securely fastens the elastic tube 1 to the eye-bolt 2. The end 3 of the elastic tube 1 is folded inward or involuted to create a smaller inner diameter against which the smaller bushing 6 is pressed. When a stress is applied (i.e., during an exercise motion), the doubled-back end 3 pulls against the annular shoulder 14 formed by the difference between the respective diameters of the adjacent smaller bushing 6 and larger bushing 8. Eye-bolt 2 is threaded through the bushings 6,8 in order to engage them, with an optional nut 15 preventing rotation of the eye-bolt 2. Alternative embodiments are also envisioned in which the larger bushing 8 has a circumferential extension defining a cup (not shown), wherein the tubing is folded inward over the extension, thereby providing a reinforced "cup" comprised of the folded tubing end and the extension and into which the smaller bushing 6 is secured. The bushings are dimensioned to correspond to various size elastic tubing that may be employed in the system, but for the purpose of providing an example a larger bushing may have a 1" outer diameter and 1" length, while a corresponding smaller bushing could have an outer diameter of ¾" and a comparable or slightly shorter length.

Figure 1E:
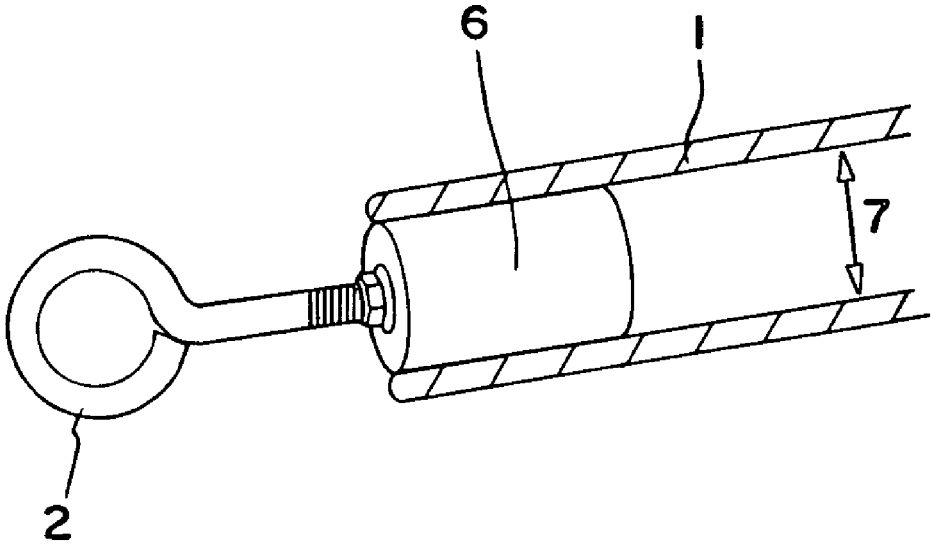
Figure 1F:
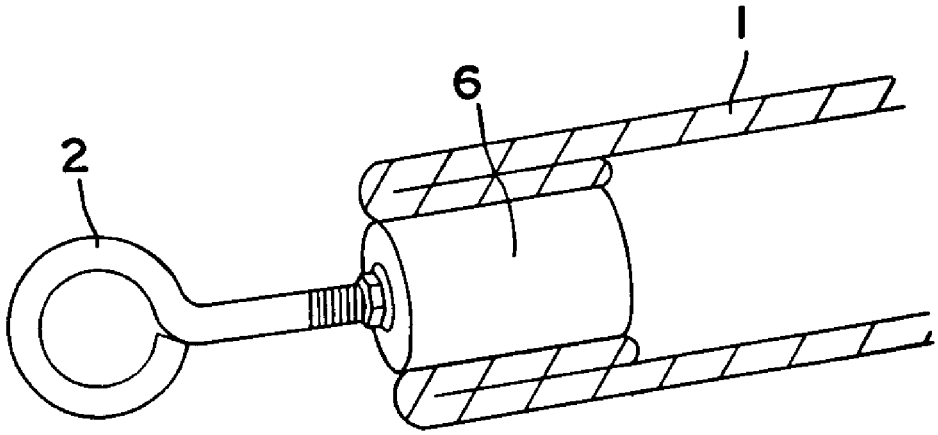

FIGS. 1E and 1F illustrate two other configurations of the assembled connector portions. In the first, a single threaded bushing 6 is connected to an eye-bolt 2 (which alternatively could be a quick connector as described below.) Bushing 6 is has an outer diameter that approximates the inner diameter 7 of the elastomeric tubing 1. This provides a sufficient mechanical connection between the tubing and the bushing, especially when using tubing having lower inner diameters, for example, in the range of ¼". The tubing is represented in two alternative embodiments, one in which the tubing is involuted and one in which it is not.

Figure 2A:
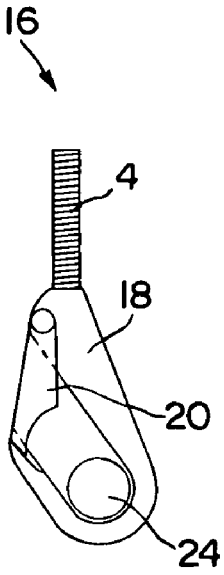
FIGS. 2A–2B are schematic illustrations of embodiments of carabiner-type connectors disposed at the end of a threaded connector.
Figure 2B:
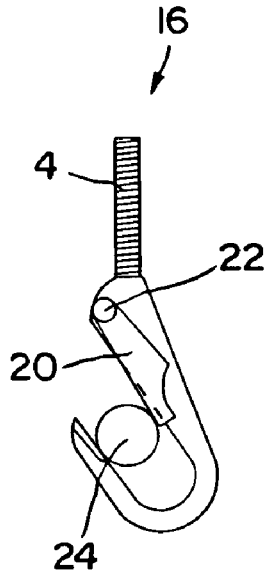
Figure 3A:
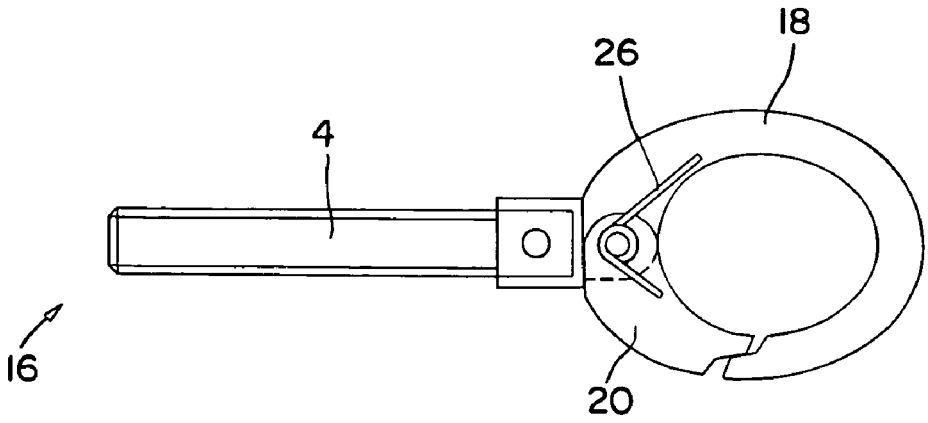
FIGS. 3A–3C are schematic illustrations of embodiments of carabiner-type connectors disposed at the end of a threaded connector.
Figure 3B:
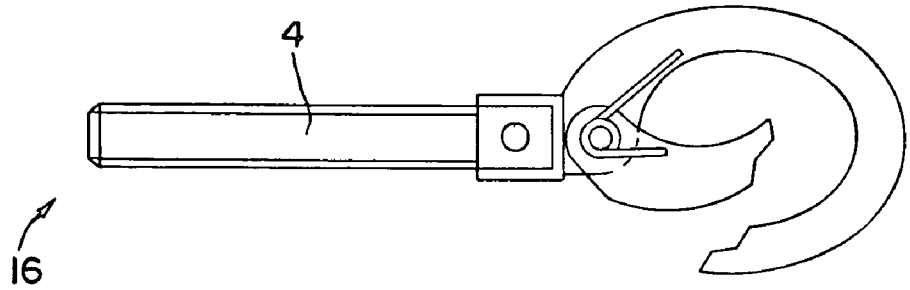
Figure 3C:
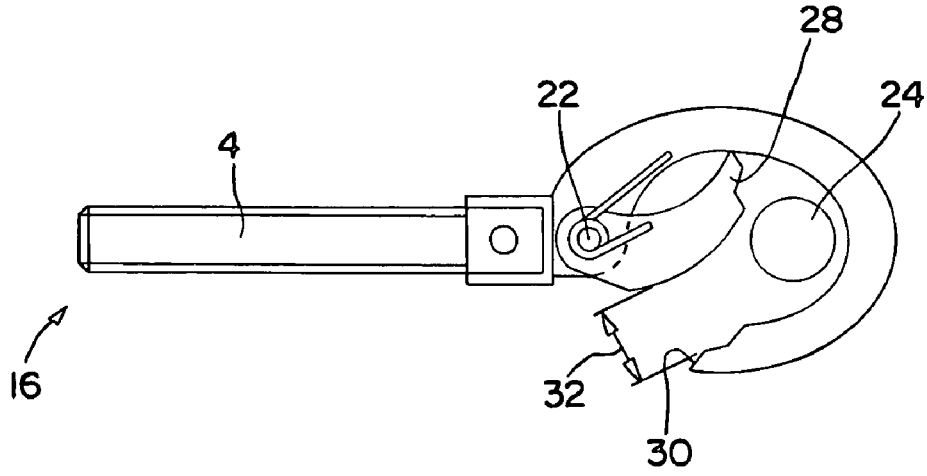

FIGS. 2A–B and 3A–C show threaded connectors 16 that are used in preferred embodiments of the system rather than eye-bolts. These carabiner-type connectors reduce the possibility of disconnection of the elastic tube assembly from a hook. As shown in FIGS. 2A–2B, the preferred connectors 16, referred to by the inventors as Quadrilinks, are comprised of a thread portion 4, a solid hook portion 18 preferably cast as a single piece including the thread portion, and a spring loaded arm 20 that moves about a pivot point 22 with respect to the hook portion 18. FIGS. 3A–3C illustrate another embodiment of the threaded connector 16 and the process for attaching the connector to some other attachment of the exercise system. The other attachment is represented in FIG. 3C as component 24, and could be a portion of an exercise bar in direct-connection configurations. Component 24 could alternatively be eye loops or hooks, for example, connection to chains or other means to lengthen the total length between two opposed ends of the exercise system (as discussed below.) The pivoting motion of arm 20 with respect to the hook portion 18 is controlled by the user and a spring 26 that forces the arm 20 back into a closed position (as shown in FIG. 3A) but enables the arm to be pivotably moved by the user to an open position (as in FIGS. 3B–C) to enable connection of the threaded connector 16 to the component 24.

In the normally closed position, the non-pivoting end 28 of arm 20 is preferably received by a notch or groove in the end 30 of the hook portion 18. The hook portion 18 and arm 20 are dimensioned so as to allow a sufficient opening 32 for component 24 to be received, as well as to allow arm 20 to return to the closed position without hindrance from the received component 24. The threaded connectors, like several of the other parts of the system, are constructed preferably of a durable metal material, but are not intended to be limited thereto. The thicknesses of the hook portion 18 and arm 20 must be sufficient to provide strength, but preferably are of a thickness that allow multiple connectors to be attached to a single eye loop, for example, in those embodiments where multiple elastic tube assemblies are used by a user in parallel to achieve greater resistive force for an exercise. The figures demonstrate that there is some design flexibility in the overall shape (e.g., circular, oval) of the hook and arm assembly, as well as in the exact location of the pivot 22.

Figure 2C:
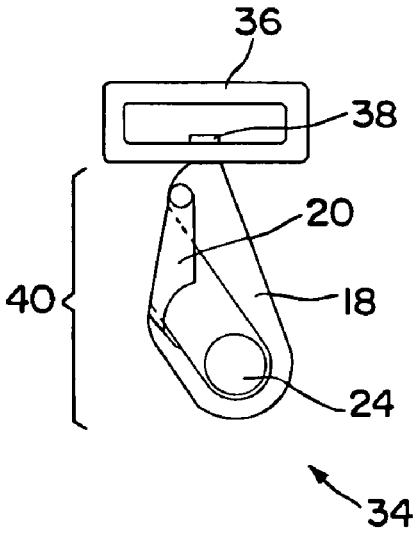
FIGS. 2C–2D are schematic illustrations of embodiments of carabiner-type connectors disposed at the end of a connector for use with a buckle.
Figure 2D:
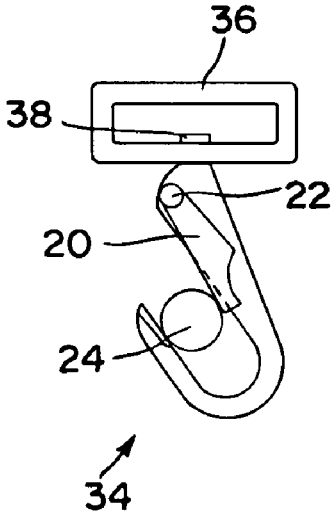

FIGS. 2C–D illustrate alternative connectors 34 that may be used in other embodiments. Connectors 34 include similar locking mechanisms, but may have a much shorter threaded portion and locking nut 38, or alternatively a pin or bolt, for connecting the hook portion 18 to a buckle 36 for receiving an exercise strap (not shown.)

The light weight tubing employed in the system is preferably composed of an elastomer providing tensile resilience according to the parameters exemplified below provided by pure natural rubber latex, commonly known as "latex". The inventors have conducted numerous experiments to approximate the equivalent force that can be achieved by using tubes of various dimensions and stretch distances. The values presented in Table One below are just a sampling of equivalent forces attainable using a ⅛" thick tubing and are meant in no way to be limiting; the ability exists (e.g., by varying the tube lengths and thicknesses and/or numbers of tubes used) for the exercise system of the present invention to provide hundreds of pounds of resistive force.

TABLE ONE

| Exercise | Tube Dimensions | Stretch Distance | Equivalent Force (lbs.) |
|---|---|---|---|
| Press | ¼" i.d. × 7.75" long | 18" (four tubes) | 80 lbs |
| Press | ⅜" i.d. × 7.75" long | 18" (four tubes) | 160 lbs |
| Press | ½" i.d. × 9.5" long | 18" (four tubes) | 165 lbs |
| Press | ¾" i.d. × 9" long | 18" (one tube) | 200 lbs |
| Dip | ¼" i.d. × 7.75" long | 16.5" (four tubes) | 80 lbs. |
| Dip | ⅜" i.d. × 8.75" long | 16.5" (four tubes) | 110 lbs |
| Dip | ½" i.d. × 11" long | 16.5" (four tubes) | 140 lbs |
| Dip | ¾" i.d. × 16.5" long | 16.5" (four tubes) | 170 lbs |
| Curl | ¼" i.d. × 17.5" long | 36.5 (two tubes) | 26 lbs. |
| Curl | ⅜" i.d. × 17.5" long | 38.5" (two tubes) | 40 lbs |
| Curl | ½" i.d. × 18" long | 38.5" (two tubes) | 50 lbs |
| Curl | ¾" i.d. × 16" long | 38.5" (two tubes) | 65 lbs |
| Dead Lift | ¾" i.d. × 9" long | 12" (two tubes) | 80 lbs |
| Leg Extension | ¾" × 9" long | 6" (two tubes) | 40 lbs |
| Overhead Curl | ¾" × 19.5" | 24" (one tube) | 50 lbs |
| Sh. Shrugs | ¾" × 9" long | 14" (four tubes) | 160 lbs |
| Flies | ½" i.d. × 20" long | 20" (one tube) | 40 lbs |
| Ab Crunch | Spring 15/16" × 6" | 2.75" | 100 lbs |

A person committed to an exercise routine will progress in their physical abilities and will most likely wish to incrementally increase the resistive force encountered during each exercise to challenge themselves anew. Unlike typical portable exercise equipment, which employ expanding materials that lose their elasticity and become elongated, latex resists such deformation. Increasing the number of repetitions is the only choice for many users of such typical portable exercise equipment. The present system, however, allows a user to incrementally increase the resistive forces encountered in a number of ways. For example, a user could simply select a tube of different dimensions than the tube found no longer challenging to the user. Alternatively, the user could use multiple tubes (as described below.)

Figure 5A:
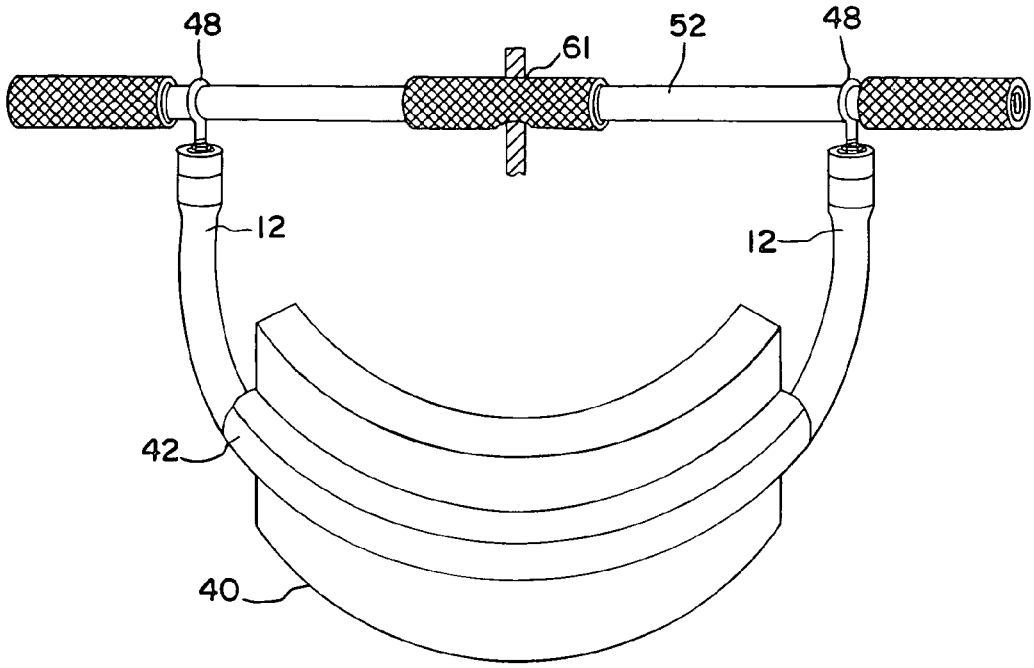
FIG. 5A-5B are schematic illustrations of a "bench press" configuration of the exercise system, equipped with an inelastic adjustment strap.
Figure 5B:
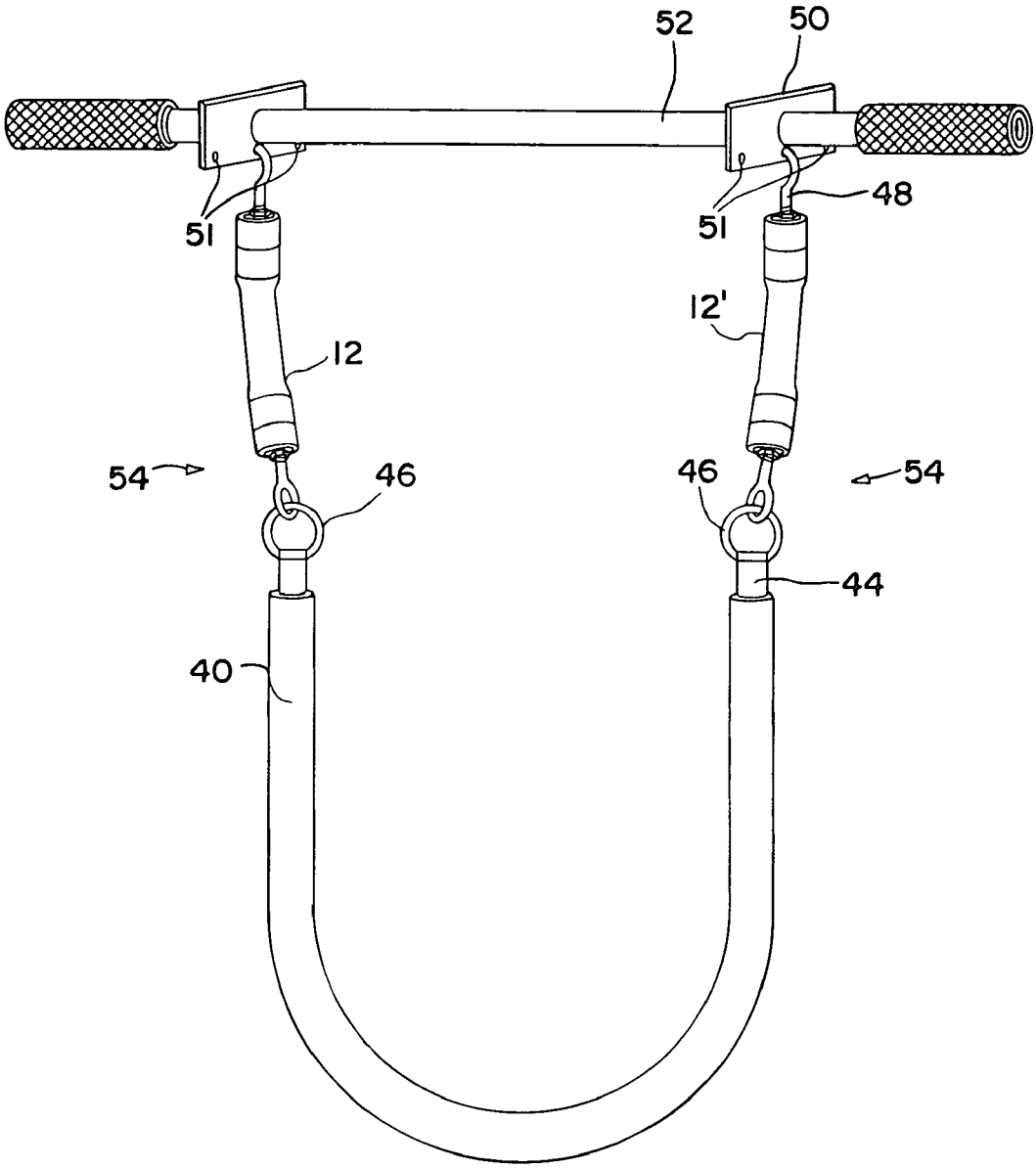

FIG. 5A shows a configuration of the exercise system that allows a user to perform "bench press" exercises. A cushioned back pad 40 is provided in which one tube assembly 12 or two tube assemblies (each having an end terminating within the back pad and not shown) may be secured in an envelope open at the longitudinal ends and defined by a lateral flap 42 permanently secured to the main body of the pad 40 along one length of the flap and releasably secured at the other length for example by Velcro fasteners, hooks, buttons. In an alternative embodiment shown in FIG. 5B, a longitudinally inelastic strap 44 is strung through or integral to back pad 40 (which optionally may have the lateral flap 42) to which up to three tube assemblies 12 (only one shown) may be attached to each strap terminator 46, which are shown as metallic rings interwoven or otherwise fastened to the strap, but could be any mechanism for securely connecting tube assembly ends 54 to the strap 44.

Figure 7:
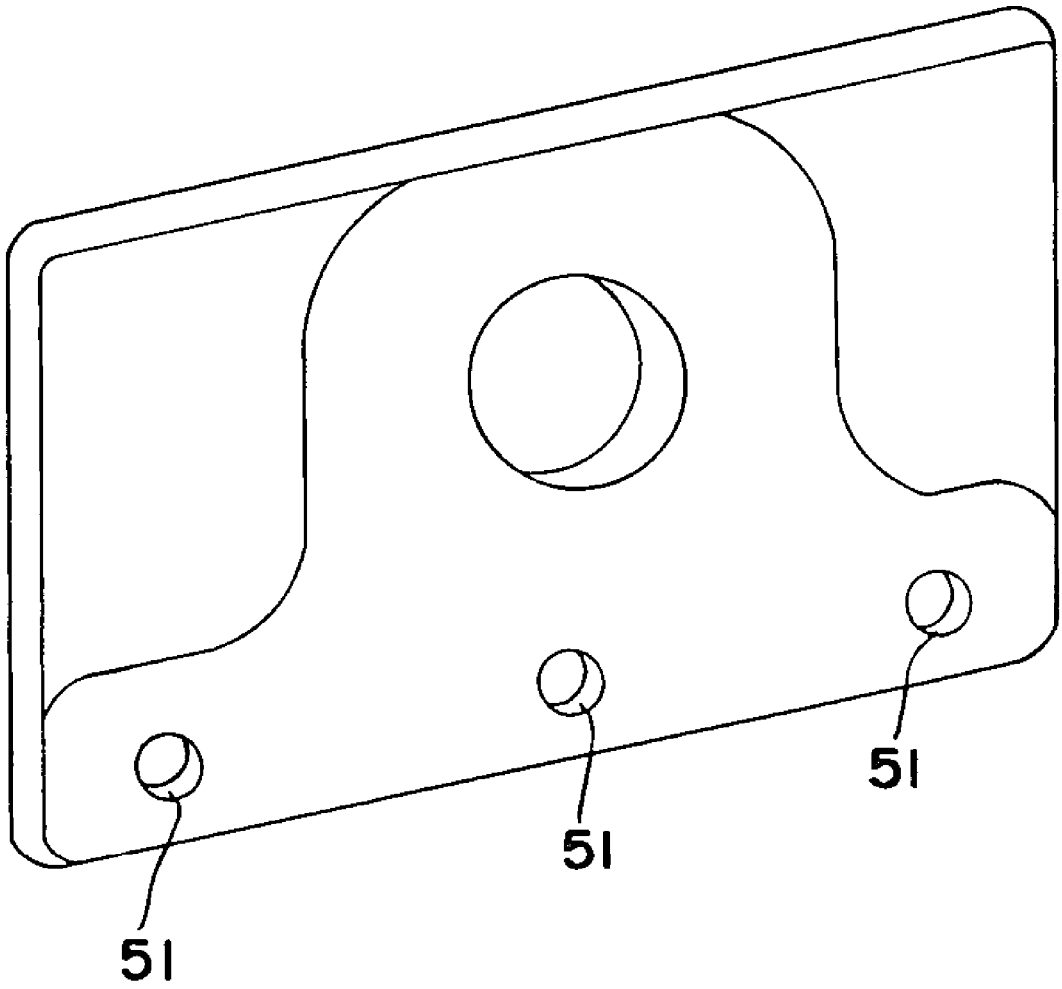
FIG. 7 is an illustration of a back pad including ring-type terminators enabling distance adjustments between the pad and the rigid bar to which it will be connected via a latex tubing assembly.

Each end 48 of each tube assembly 12 not connected to the strap 44 are preferably connected, via one of the connectors described above, to a corresponding plate 50 whose axially position along bar 52 has been previously fixed. Each plate 50 includes a plurality of holes 51 to accommodate use of a plurality of tube assemblies 12. Alternatively, those ends 48 could be connected directly to the bar 52. The plates 50 may have a rectangular shape, or may be esthetically contoured, such as shown in FIG. 7.

Figure 6:
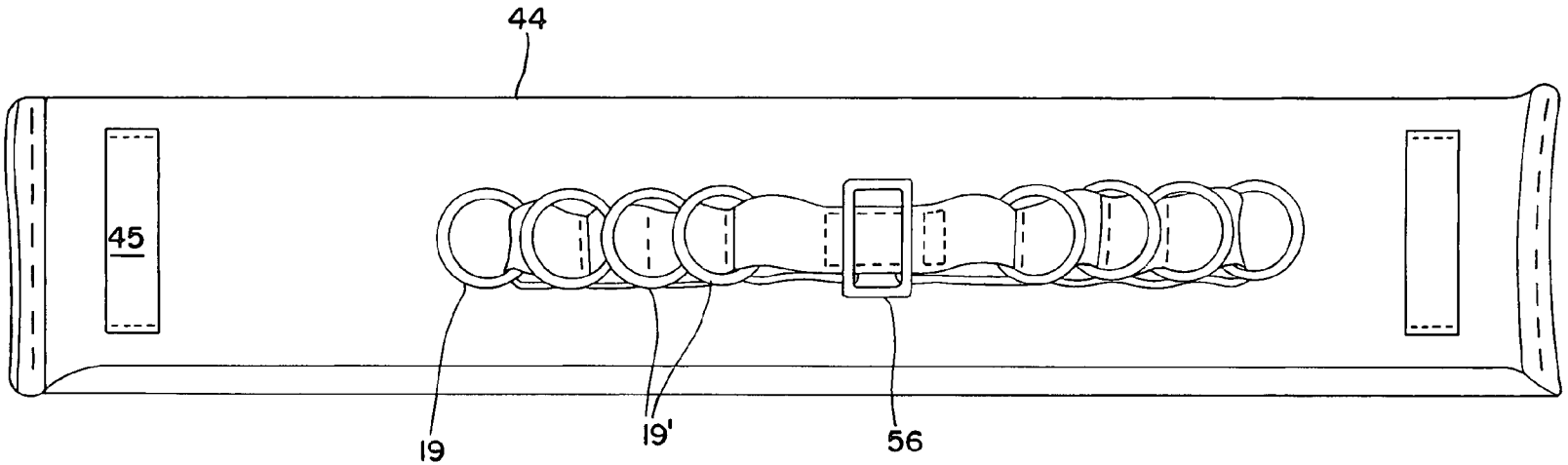
FIG. 6 is a schematic illustration of a preferred configuration of the exercise system employing multiple latex tube assemblies.

Several mechanisms are available for adjusting the distance between the back pad 40 and bar 52 to accommodate various user sizes, while maintaining the ability to use the same tube assembly or assemblies. First, a number of chain links may be connected between each end 48 and each plate 50, or similarly connected between tube assembly ends 54 and the strap terminators 46. In a preferred embodiment illustrated in FIG. 6 and employing multiple tube assemblies, the distance adjustment is effected by using a strap 44 that includes at least two terminators 19 disposed one on each end, and optionally a plurality of additional terminators 19' at various positions along the strap 44 and similarly interwoven or otherwise fastened to the strap. Some embodiments also optionally include a buckle 56 by which the strap length may be shortened, but preferably the terminators 19, 19' are interwoven. To obtain the proper distance adjustment, a user simply needs to connect the tube assembly ends 54 to a selected set of terminators 19,19' to attain the desired distance between the back pad 40 and bar 52. A pair of belt loops 45 are attached at opposing ends of the strap 44 for guiding and constraining the lateral motion of tube assemblies connected to the terminators. Suggested dimensions of the strap include a width between 6" and 8" and a length between 2' and 3', but such dimensions are understandably user-dependent.

The back pad includes sufficient padding (e.g., 1" thick foam) for comfortable exercise, but is also layered to include a pouch region of sufficient size (e.g., two feet in length) to include all of the individual components of the exercise system.

Figure 8A:
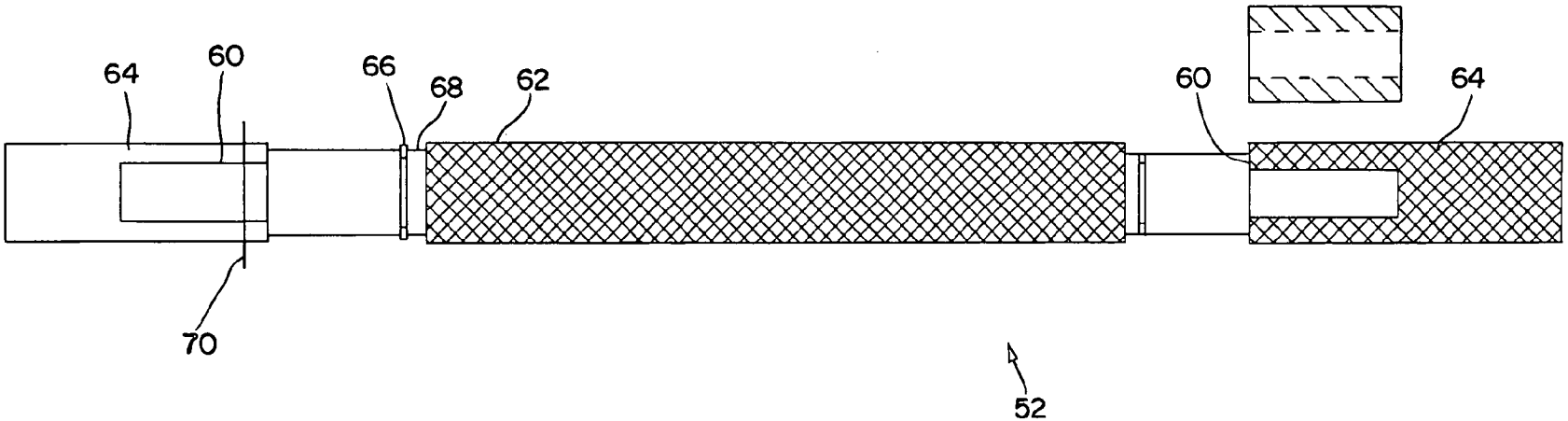
FIGS. 8A–8B are schematic illustrations of a multi-segment embodiment of a rigid bar.
Figure 8B:
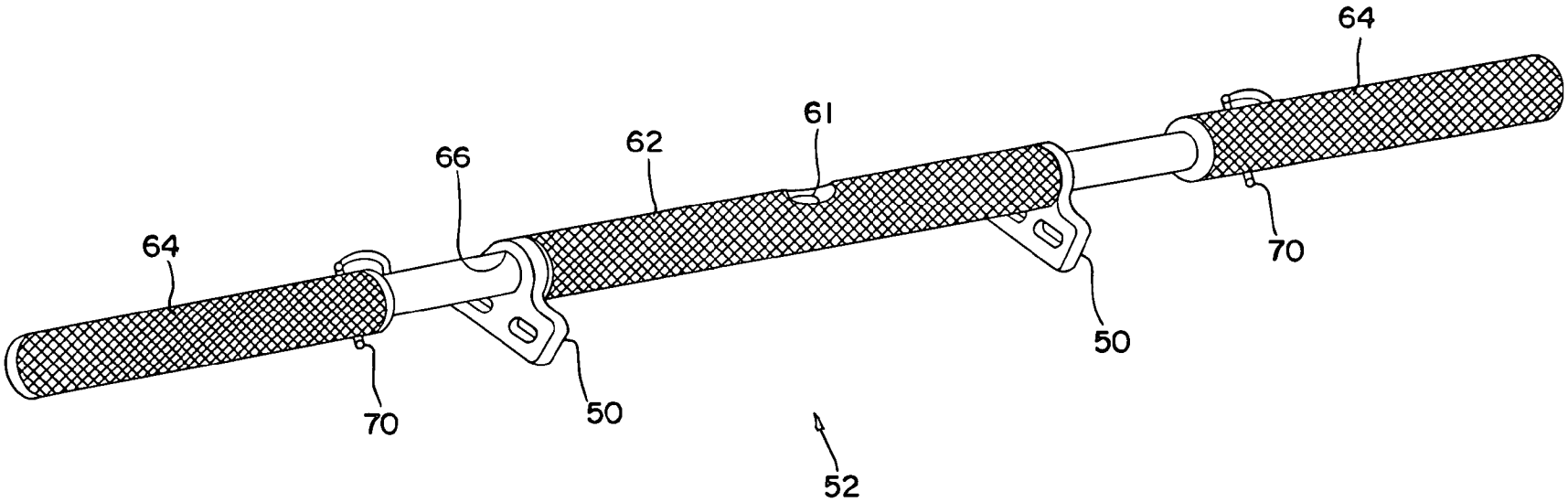

FIG. 8A illustrates the bar 52 (without plates 50), which is comprised of a steel core or shaft 60 about which are disposed an optional knurled aluminum center segment 62 and two optional, removable handle extensions 64 for performing wide armed bench presses. Plates 52 (not shown) are positioned at corresponding locations 68 on each side of the center segment 62 and axially constrained by conventional O-rings 66. Each handle extension 64 is secured by a corresponding bar retention pin 70 that traverses a channel formed through each handle extensions 64 and a corresponding portion of the steel shaft 60. FIG. 8B presents another view of the bar 52, here equipped with plates 50 (the internal shaft is not shown in this figure.) Bore hole 61 is illustrated as positioned equidistant from the ends of center segment 62. Center segment 62 may be used independent of the handle extensions in configurations of the exercise system enabling abdominal exercises, as described below and with reference to FIGS. 9A and 9B. The bar is dimensioned to allow easy but secure gripping, for example, with an outer diameter of approximately 1½".

Figure 9A:
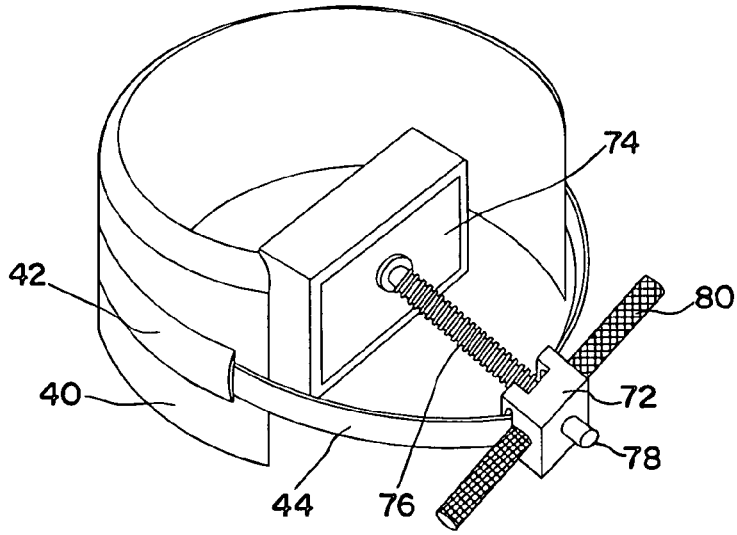
FIGS. 9A–9B are a schematic illustrations of an abdominal crunch configuration of the exercise system.
Figure 9B:
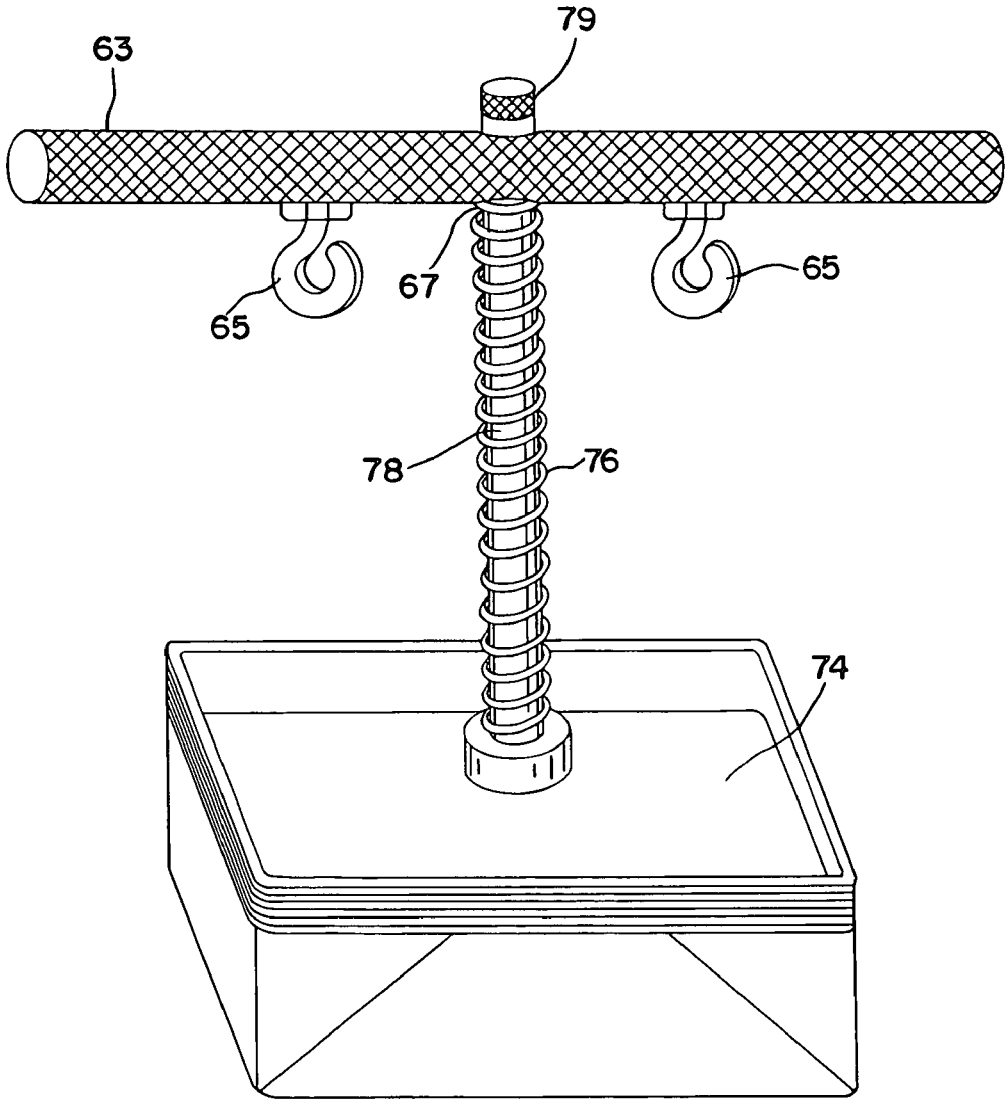

FIGS. 9A and 9B illustrate use of components of the exercise system for abdominal exercise. FIG. 9A shows a configuration employing the same back pad 40 and longitudinally inelastic strap 44 adjustably secured to a frame 72 attached to a cushioned block 74 through a spring 76 and guide rod 78. The abdomen is exercised by engaging block 74 and pushing outward against the spring 76, which is coiled around guide rod 78 and which compresses between block 74 and frame 72. Knurled handles 80 attached to the frame 72 are provided to aid in the positioning of the apparatus. FIG. 9B illustrates an alternative embodiment (back strap not shown) that includes a cushioned block 74, spring 76 and guide rod 78. One end of the spring terminates at block 74 and the other end at a recess 67 in bar 63. One end of the guide rod 78 extends through bore hole 61 in bar 63 and is threaded to receive threaded nut 79. Although bar 63 is depicted as including a pair of hooks 65 to which the back pad may be connected, bar 63 may comprise the central segment 62 (as shown in FIGS. 8A and 8B) allowing connection of the back pad to plates 50 disposed at each each of the central segment. For exemplary purposes only, the following dimensions are provided for the components in this abdominal exercise configurations: the block 74 is 4" wide and 5" long, and includes a ½" thick aluminum portion and a 1½" thick foam cushion portion; the guide rod is comprised of a ⅝" diameter and 9" long steel shaft; and the distance between the block 74 and the frame (i.e., either another block or the bored bar) is approximately 7".

Figure 10A:
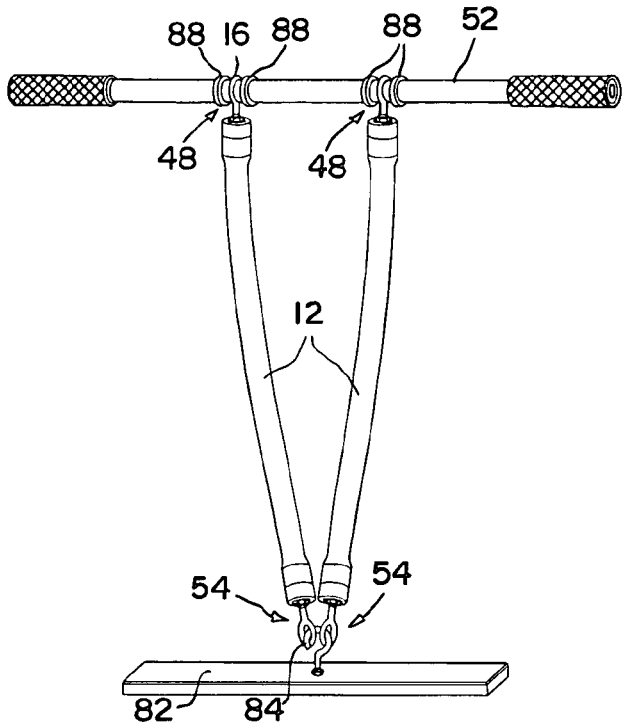
FIGS. 10A–10C are schematic illustrations of "curl-type" configurations of the exercise system.
Figure 10B:
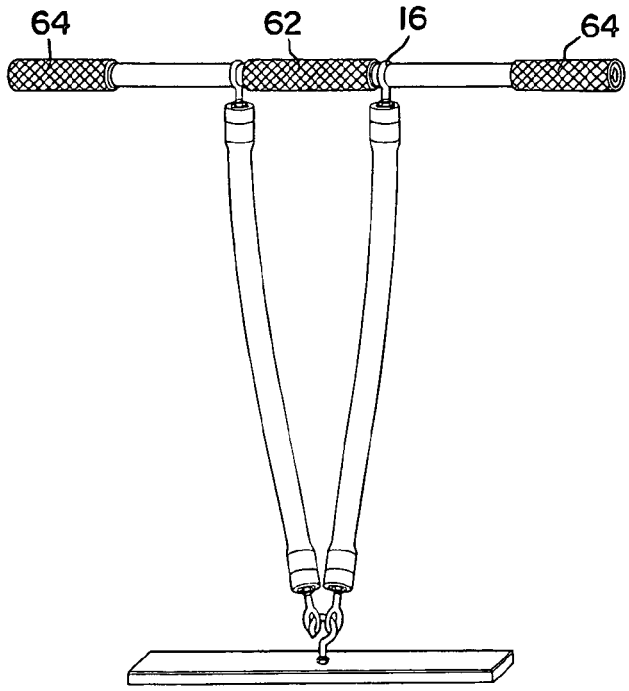
Figure 10C:
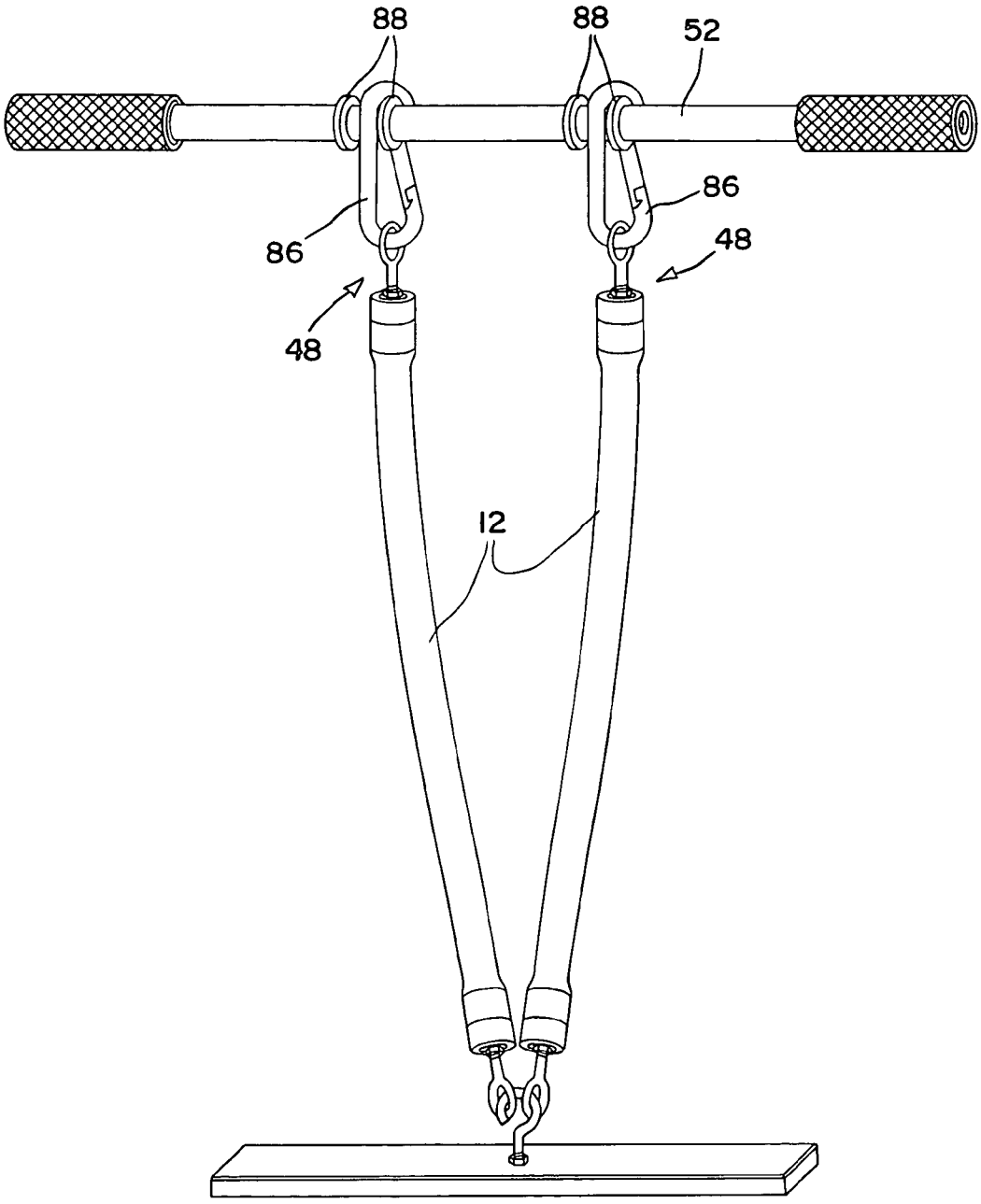
Figure 10D:
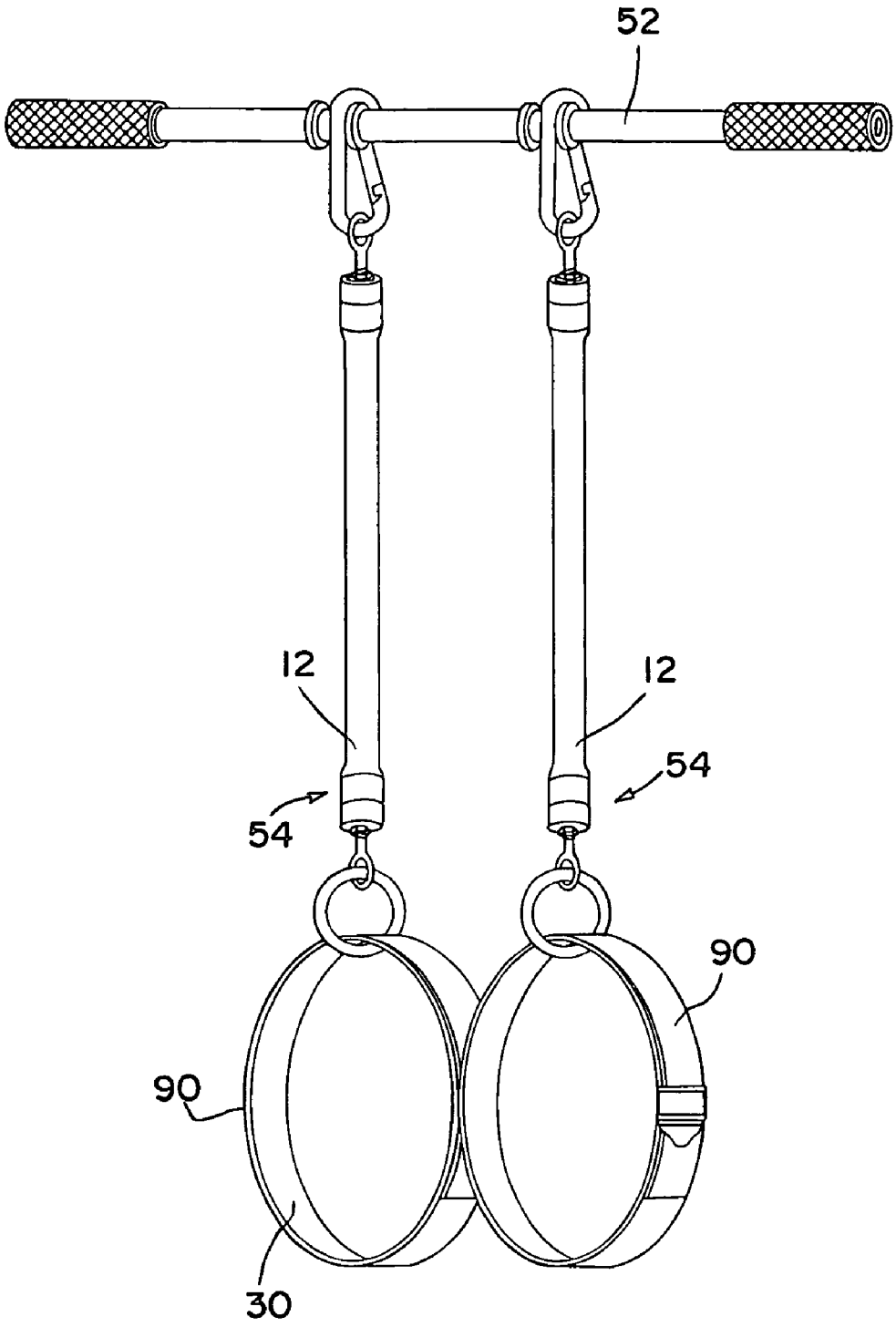

With reference to FIGS. 10A–B, the system may be configured to perform bicep and/or tricep curl exercises. Each of a pair of elastic tubing assemblies 12 selected to provide the desired resistive force are connected at one end 48 to the bar 52 and to a foot plate 82 through a linking component 84 at their respective other end 54. The user may then grip the bar 52 while standing on the foot plate 82 and raise the bar to perform the exercise. Numerous variations and adjustments are possible. For example, as described above, multiple pairs of tube assemblies 12 may be used to arrive at the desired resistive force, and inelastic chain or cable segments may be inserted between the connections 48–52 and 54–84 to adjust the distance between bar 52 and foot plate 82. Also, the connections to the bar and foot plate may employ the threaded quick connectors 16 described above, thus obviating the need for open hooks such as linking component 84 of FIGS. 10A–C, or the latches 86 shown connecting the upper ends 48 of the elastic tubing assemblies 12 to the bar 52. Bar 52 may optionally include stabilizer rings 88 to constrain the axial movement of the tube assembly connections axially along the bar, or may simply rely on the knurled center segment 62 and handles 64 to constrain said motion.

Figure 11:
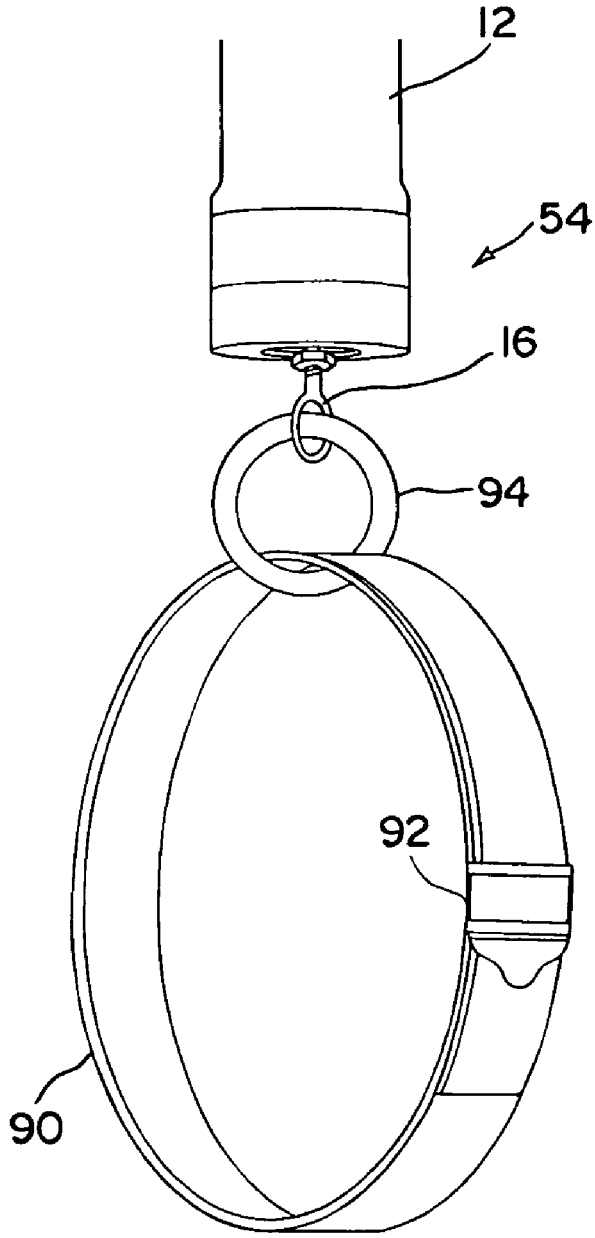
FIG. 11A-11B is a schematic illustration of another curl-type configuration, wherein the foot plate is replaced by a pair of foot stirrups.
Figure 12:
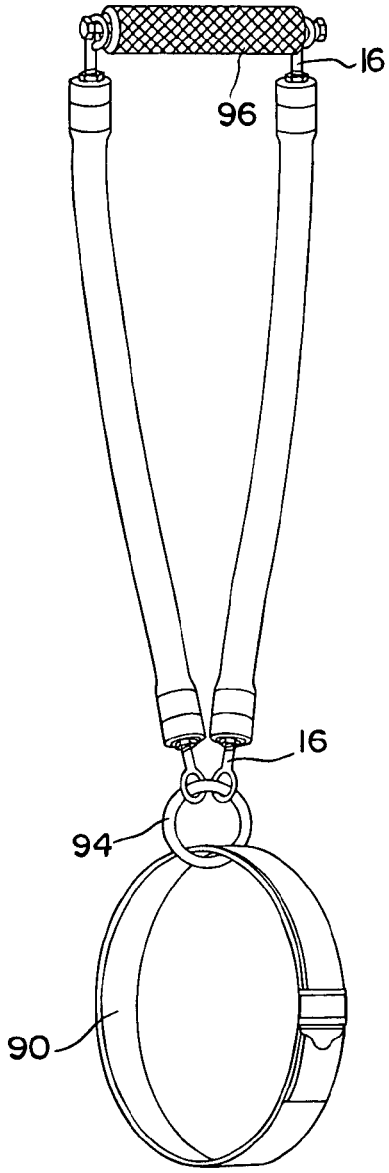
FIG. 12 is a schematic illustration of a single-foot/single-arm curl-type configuration of the exercise system.

In another embodiment enabling curl-type exercises, illustrated in FIG. 11A-11B, the foot plate may be replaced by a pair of foot stirrups 90 including an adjustable buckle 92 and a connector ring 94. Connector ring 94 can be quickly connected and disconnected from a elastic tubing assembly 12 through use of a quick connector 16. Foot stirrups may be preferable to foot plates in that it may be less likely that a user's foot will slip out of a stirrup than it is likely that the user's foot may shift during the exercise causing at least part of the foot plate to lift up perhaps quickly. FIG. 12 shows an embodiment in which a single foot stirrup 90 is connected, via a pair of tubing assemblies 12, to a short bar 96. This allows curl-type exercises concentrating on one arm at a time.

Figure 13A:
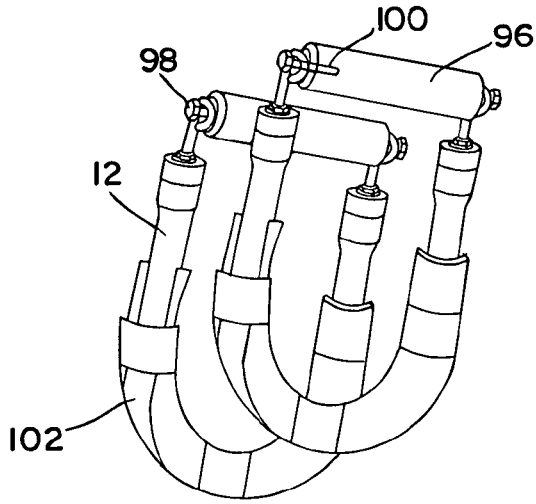
FIGS. 13A–B are schematic illustrations of the use of the short bar in a configuration allowing shoulder exercises such as dips.
Figure 13B:
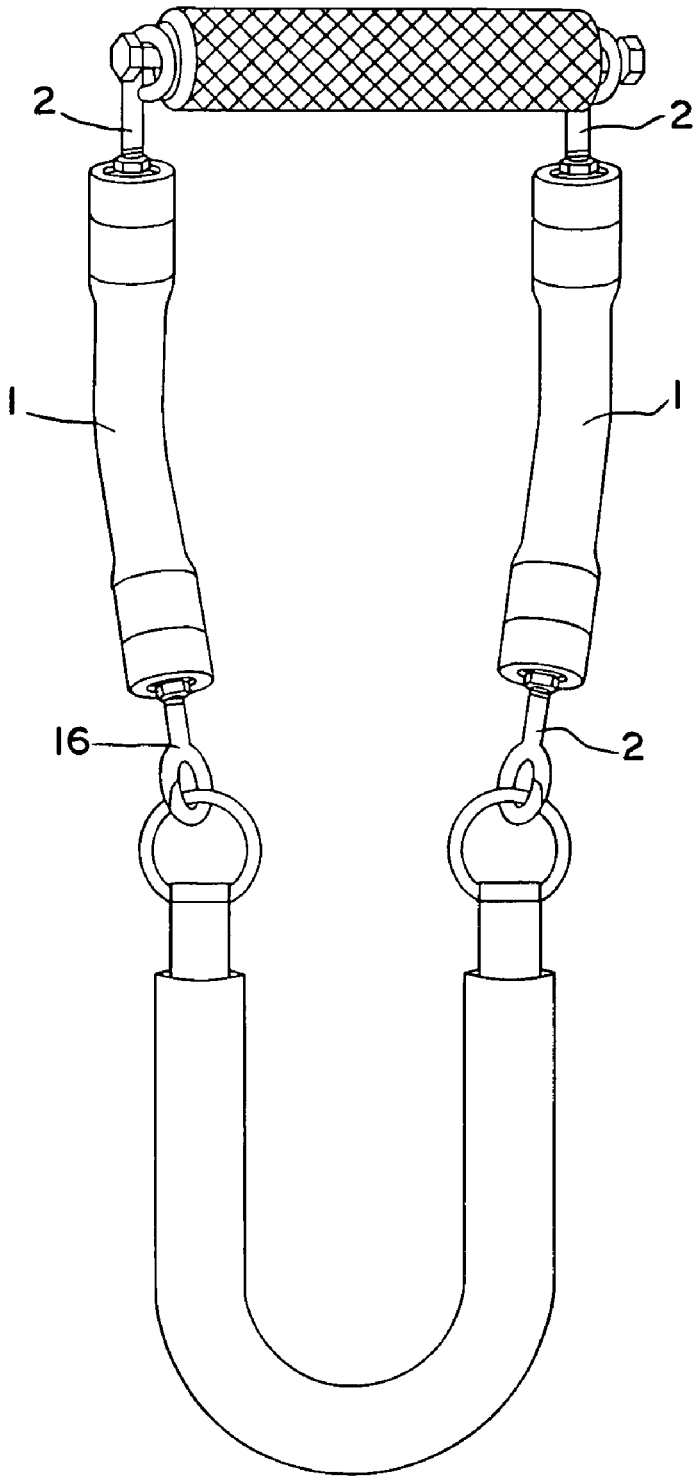

FIGS. 13A–B illustrate the use of the short bar 96 in a configuration allowing shoulder exercises such as dips. Connections between one or more elastic tubing assemblies 12 and the short bar 96 preferably employ the quick connectors 16 described above, but may alternatively use eyebolts 2 through which is threaded a connecting bolt 98 that is received by a threaded recess 100 in the short bar 96. A shoulder harness 102 and strap (not shown) comparable to the back pad and strap described above are preferably employed to make user-specific length adjustments, but introduction of inelastic extenders such as chain links may also be employed.

Figure 14:
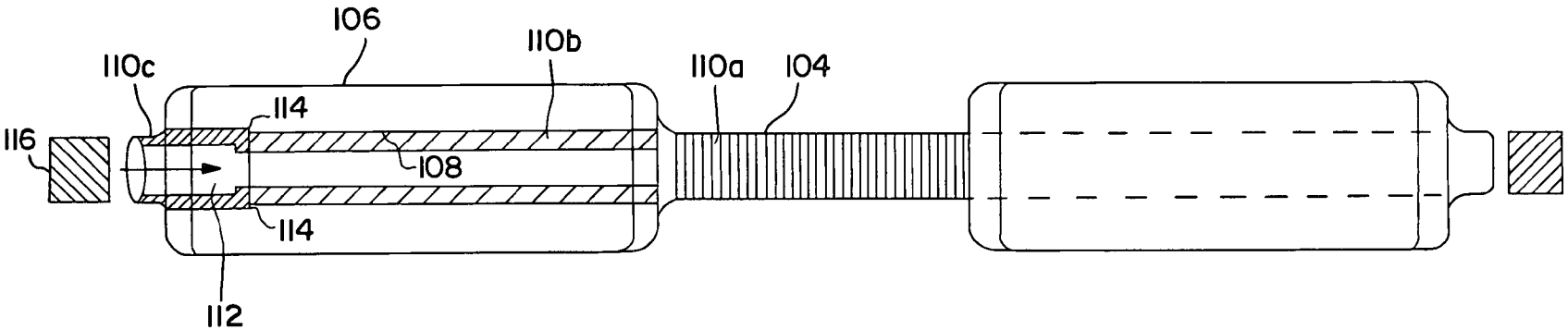
FIG. 14 is a schematic illustration of a two handle embodiment of the exercise system provided by the present invention.

FIG. 14 illustrates another embodiment of the exercise system provided by the present invention. In this configuration, an elastic rubber tube 104 is threaded through bores 108 of a pair of handles 106. The exterior surfaces of the handles 106 are preferably knurled for easier gripping. The bores 108 have a diameter approximating the outer diameter of section 110*b* of the rubber tube 104, which preferably is comprised of a center segment 110*a* having a outer diameter greater than the diameter of the bores 108, two bore segments 110*b* having a smaller outer diameter than the outer diameter of the center segment 110*a*, and a pair of plug segments 110*c* having a larger inner diameter than the diameter of the bore segments for securing the rubber tube to the handles 106. A mechanism for securing the rubber tube 104 to the handles 106 will now be described. Each handle has a recess 112 on one end of a diameter greater than the diameter of the bore 108. Dimensions provided hereinafter are in no way meant to be limiting. The bores 108 may be ⅝" in diameter and the handles 106 may have diameters of approximately 1½". The recess may be about ⅞" in diameter, thereby forming a ¼" annular ridge 114. The annular ridge 114 provides a surface against which a portion of the plug segment 110*c* of the tube 104 will be tightly held by plug 116, which in this particular embodiment has a ¾" outer diameter. Plug 116 has an outer diameter greater than the diameter of the bore 108 but just less than the inner diameter of the plug segment 110*c* of the rubber tube. Inserting the plug snugly within the plug segment of tubing and then against the annular ridge 114 precludes the tube from slipping out from the handle. The plug can be further secured by other means, such as additional tightly fitting or threaded bushings (not shown), but the inventors' experience shows that the mechanism depicted is sufficient to preclude tube slippage.

A variety of exercises beyond those specifically described with respect to particular configurations are possible. For example:

shoulder pull-ups—a user can stand with one hand grasping the handle (short bar) attached to a tube assembly and foot stirrup, then pull up and out away from the body until the arm is fully extended and slowly return to the starting position;

shoulder shrugs—standing with each hand grasping the short bar handle attached to the tube and foot stirrup, a user then can slowly pull up on the handles by raising his shoulders only;

upright rows—grasping the middle of the bar 6–10" apart with and overhand grip and standing upright with the bar resting on the thighs, a user can lift the bar towards his chin by bending the elbows;

front raises—standing and grasping the bar 6–10" apart with an overhand grip and keeping the arms straight, the user can then raise the bar until it reaches eye level;

military presses—putting a stirrup under the arch of each foot and stand with his feet shoulder width apart, a user can then grasp the handles on the bar with palms facing out and raise it to chest level, then push the bar upward until his arms are fully extended; and bent-over bar rows—a user can bend his knees, arch his back, lift his head up, grasp the handles on the bar with an overhand grip and pull it toward his abdomen.

While the foregoing specification has been described with regard to certain preferred embodiments, and many details have been set forth for the purpose of illustration, it will be apparent to those skilled in the art, that without departing from the spirit and scope of the invention, the invention may be subject to various modifications and additional embodiments, and that certain of the details described herein can be varied considerably without departing from the basic principles of the invention. Such modifications and additional embodiments are also intended to fall within the scope and spirit of the invention appended claims.

What is claimed is:

1. An abdominal exercise system, comprising:

a rigid plate having a padded surface for engaging a portion of a user's abdomen;

a guide rod extending from the rigid plate through a block;

a spring having a first and second end, disposed about the guide rod, the first end in contact with the rigid plate and the second end in contact with the block, the spring providing resistive force against the motion of the rigid plate toward the block;

a back pad including a padded portion having a first surface for engaging an area of the lower back of the user opposite the user's abdomen, and a strap means for adjusting the distance between the back pad and the block, thereby also adjusting the resistive force provided by the spring.

2. The abdominal exercise system of claim 1, further comprising two handles connected on opposing sides of the block.

3. The abdominal exercise system of claim 1, wherein the adjustment strap means comprises:

a strap portion having two ends terminating at the block; and means for securing the strap portion adjacent to a second surface of the padded portion.

4. The abdominal exercise system of claim 3, wherein the strap portion comprises a single strap adjustable via a buckle.

5. The abdominal exercise system of claim 3, wherein the strap portion comprises two straps each having a first and second end, said two first ends terminating at the block, and said second ends each connectable at a respective selectable position along the second surface of the padded portion.

* * * * *